US007958919B2

(12) United States Patent
Mackenzie et al.

(10) Patent No.: US 7,958,919 B2
(45) Date of Patent: Jun. 14, 2011

(54) FILL VALVE FOR AN AEROSOL CONTAINER

(75) Inventors: Robert Mackenzie, Grayslake, IL (US); Ronald Boucher, Rochester, MA (US)

(73) Assignee: Ball Corporation, Broomfield, CO (US)

( * ) Notice: Subject to any disclaimer, the term of this patent is extended or adjusted under 35 U.S.C. 154(b) by 442 days.

(21) Appl. No.: 12/263,067

(22) Filed: Oct. 31, 2008

(65) Prior Publication Data

US 2010/0108192 A1 May 6, 2010

(51) Int. Cl.
*B65B 3/00* (2006.01)
*B65B 3/04* (2006.01)

(52) U.S. Cl. ..... 141/350; 141/113; 141/2; 141/3; 141/20

(58) Field of Classification Search ..... 141/2, 3, 141/20, 350, 18, 301, 113; 53/470, 471
See application file for complete search history.

(56) References Cited

U.S. PATENT DOCUMENTS

| | | | | |
|---|---|---|---|---|
| 3,337,091 | A | 8/1967 | Bartels | |
| 3,522,900 | A | 8/1970 | Nicholson | |
| 3,981,119 | A | 9/1976 | Schultz | |
| 4,658,979 | A | 4/1987 | Mietz et al. | |
| 4,750,314 | A * | 6/1988 | Mietz et al. | 53/470 |
| 4,877,065 | A * | 10/1989 | Lamboy et al. | 141/18 |
| 5,244,117 | A * | 9/1993 | Lombardo | 141/3 |
| 5,915,595 | A | 6/1999 | Dow et al. | |
| 6,729,362 | B2 | 5/2004 | Scheindel | |
| 6,945,284 | B1 | 9/2005 | Hurd et al. | |
| 7,225,839 | B2 | 6/2007 | Mackenzie et al. | |
| 7,337,916 | B2 * | 3/2008 | Clougherty | 220/785 |
| 7,708,171 | B2 * | 5/2010 | Regan et al. | 222/389 |
| 2004/0065381 | A1 * | 4/2004 | Scheindel | 141/20 |
| 2005/0016622 | A1 * | 1/2005 | Risch et al. | 141/113 |

FOREIGN PATENT DOCUMENTS

| | | |
|---|---|---|
| EP | 0560573 | 9/1993 |
| WO | WO 97/37894 | 10/1997 |

OTHER PUBLICATIONS

Johnsen, M.A., "Compartmentalized Dispensers: Part III The Bottom Plug," Spray Technology & Marketing, Jan. 1, 2002, pp. 22-28, XP009065892.

Ouhadi, T. et al., "High-Flow Thermoplastic Vulcanizates," Plastics Engineering, Society of Plastics Engineers, Inc., Aug. 1, 1996, vol. 52, No. 8, pp. 37-39.

* cited by examiner

*Primary Examiner* — Khoa D Huynh
(74) *Attorney, Agent, or Firm* — Sheridan Ross P.C.

(57) ABSTRACT

A fill valve for selective interconnection with a container is provided. The fill valve includes a head shaft and shoulder separated by grooves that are selectively positioned in an aperture of the container to selectively provide a flow path into the container.

10 Claims, 5 Drawing Sheets

FILL VALVE FOR AN AEROSOL CONTAINER

FIELD OF THE INVENTION

Embodiments of the present invention are related generally to valves that are operably interconnected to the ends of aerosol containers and which allow pressurized fluid to be selectively added to the interior thereof.

BACKGROUND OF THE INVENTION

Prior art aerosol containers generally include a collapsible bag or pouch disposed therein. The bag or pouch is filled with a fluent material that is dispensed by the container upon actuation of a dispensing valve. A propellant chamber is formed between the bag and the container sidewall. A container end closure is interconnected to the bottom of the side wall and comprises a domed portion with an opening that receives a fill valve. Initially, the bag or pouch is placed in the container and the dispensing valve is attached to a top portion of the container. A propellant is subsequently injected into the container via the fill valve to pressurize the items stored within the bag. For example, a 7 oz. container may contain about 10-12 grams of propellant, such as butane, that is used to pressurize the bag. To inject the propellant, the fill valve is unseated somewhat from the container end closure to provide a space to allow propellant to flow into the chamber and to pressurize the item stored in the bag. The fill valves of the prior art generally include a stem that fits through the aperture in the container end closure, an inner sealing element formed on one side of the stem, and a "bow tie" section formed on the other end of the stem. In addition, opposed longitudinally extending grooves extend from the bow tie section along the side of the stem. During filling, a nozzle presses against the bow tie section of the valve and pushes the valve a sufficient distance inwardly to expose the grooves so that the propellant can flow into the chamber. Additionally, the pressure of the propellant causes the fill valve to flex upward to create a larger opening for the pressurized gas to enter the container. When the nozzle is withdrawn, the pressure in the chamber forces the inner sealing element of the fill valve against the inner surface of the container bottom to seal the container. An example of this type of aerosol container is generally shown in U.S. Pat. No. 5,915,595, which is incorporated by reference in its entirety herein.

A second type of aerosol container utilizes a piston disposed in the container wherein the product to be dispensed is located on an outlet valve side of the piston. The other side of the piston defines a propellant chamber that receives the propellant. The propellant is introduced to the container through a similar fill valve that is fitted into the container end closure in the manner described above.

There are a number of problems associated with aerosol containers that utilize fill valves of the prior art. One significant problem is associated with improper sealing of the fill valve subsequent to filling, which allows propellant to leak from the container. Improper sealing generally refers to a less than ideal engagement between the sealing portion of the fill valve and the aperture of the aerosol container. Propellant leakage associated with improper sealing dramatically reduces product dispensing efficiency, and if a substantial amount of propellant leaks from the container, a "dead" container will result. A "dead" container is one which does not dispense product when the outlet valve is actuated. It will be appreciated by one skilled in the art that the time between a container filling and use may be significant. This period is a function of container packaging, shipping, warehousing and storage. Any loss of propellant, however small, will affect the usefulness of the container. It has been estimated that even a small leak can result in a loss of as much as one gram of propellant per year.

Another related problem occurs during the manufacturing of the fill valve. Generally, fill valves of the prior art are compression molded which has been found to result in poor sealing associated with poor cross linking of the molded material. Cross linking is the formation of chemical links between molecular chains and polymers. Poor cross linking results in poor compression that adversely affects the seal. The result is that even if the fill valve properly seals after filling, propellant may still escape from the container over time due to this poor compression set. In addition, a cryogenic process that is used to remove flash created during compression molding is associated with poor sealing. "Flash", as used herein, refers to ancillary bits of rubber or other material formed on the finished part during the molding process. During compression molding, flash is created and is later removed by freezing of the product and chipping off the brittle flash. The cryogenic freezing process used to remove the flash may form cracks in the fill valve that potentially become leak paths.

Another problem with fill valves of the prior art is related to indicia identifying the particular mold and mold cavity from which the fill valve was formed. The indicia assists in identifying defective valves. Currently, this indicia is comprised of raised alpha/numeric characters on a surface of the fill valve. The raised characters often influence the movement of the fill valve along conveyor belts associated with the manufacturing process. This haphazard movement of fill valves may result in tipping or sticking to the conveyor belt and require additional manpower to ensure that the fill valves arrive to the assembly station and are properly oriented for insertion into the container end closure.

SUMMARY OF THE INVENTION

Embodiments of the present invention are generally related to an aerosol dispensing container incorporating a bag holding a product to be dispensed in a propellant chamber formed between the bag and a container sidewall. More specifically, an improved fill valve by which a propellant is introduced into the container and retained therein until generally all of the product in the container is dispensed is provided. The term "fill valve", as used herein shall generally refer to a grommet, umbrella valve, or seal often found interconnected to the end closure of aerosol containers of the art. Alternatively, the container may employ a piston wherein the product to be dispensed is located on one side of the piston and the propellant chamber is located on one side of the piston. Again, the improved fill valve allows a propellant to be introduced into the chamber and retained therein until generally all of the product is dispensed.

It is one aspect of the present invention to provide a fill valve for incorporation into an aerosol container that provides enhanced sealing capability. The fill valve of one embodiment is fabricated using a flashless injection molding process rather than the compression molding process previously employed. As part of this process, both the mold cavity and molding material are heated to an elevated temperatures which significantly improves the cross linking that occurs during the molding process. Further, the fill valve includes a recessed portion that improves flexing of the valve after the propellant is injected which creates a more responsive seal. Furthermore, information about the fill valve is now engraved on the surface of the valve so as to facilitate conveying of the valve during the container manufacturing process.

It is another aspect of the present invention to provide fill valve that possesses a more consistent dimensional and operational characteristics and that is thus less prone to leaking. More specifically, due to the injection molding process described above, each valve produced during manufacture includes substantially the same dimensions, thereby allowing for predictability of the fill valve.

It is another aspect of the present invention to provide a fill valve of a unique shape and dimension. For example, one embodiment of the fill valve includes a centralized shaft having a head for insertion into the container interconnected on one end and a sealing shoulder connected on another end. An upper groove separates the head from the shaft and a lower groove separates the shaft from the shoulder. Integrated into the head and the shaft is at least one passage. In some embodiments of the present invention, two fluid channels are formed laterally in the shaft wherein the two filled channels meet within the fill valve. When the upper groove is engaged within the aperture of the container end closure, the propellant is capable of flowing into the container by way of the flow channels. When the lower groove is engaged within the aperture, the channels completely positioned are within the container and thus flow of propellant into and out of the container is prevented. Prior art fill valves related to the present invention of this type are described in U.S. Pat. No. 6,945,284 to Hurd et al. and U.S. Pat. No. 7,225,839 to MacKenzie et al., both of which are incorporated by reference in their entirety herein. Both Hurd and MacKenzie each include a channel to allow propellant to enter a container. The seal provided by the fill valves of these of common prior art fill valves is about 0.00304 sq. in. Embodiments of the present invention employ a unique geometry that facilitates filling of the aerosol container while employing a seal with a surface area of about 00446 sq. inches.

The fill valve of one embodiment includes two fluid channels that are situated at an angle relative to the shaft. The two channels join at an apex located within the fill valve. The angularly-situated channels provide a greater space between the fill valve and the container when the fill valve is situated within the aperture, which facilitates filling of the container. Furthermore, the fill valve employs a portion with an enlarged diameter that acts as a seal. The fill valve includes a bore that allows the seal to flex and conform to the container, thereby improving the sealing capabilities of the fill valve.

The improved fill valve has a number of advantages over previous valves of the prior art. For example, the fill valve has a more consistent dimension and operational characteristics. Further, the improved fill valve provides a more capable seal and a valve less prone to formation of cracks. This significantly reduces the possibility of propellant leakage from a container, even those with prolonged shelf lives. This in turn, reduces warranty returns and associated costs of replacing a non-functioning or dead container. Additionally, because the improved sealing capability, the reduction in leakage reduces pollution. It may also be possible to reduce the amount of propellant injected into a container during filling because with less leakage, more propellant will remain in the container, thus additional filling to compensate for leaking will not necessarily be required.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
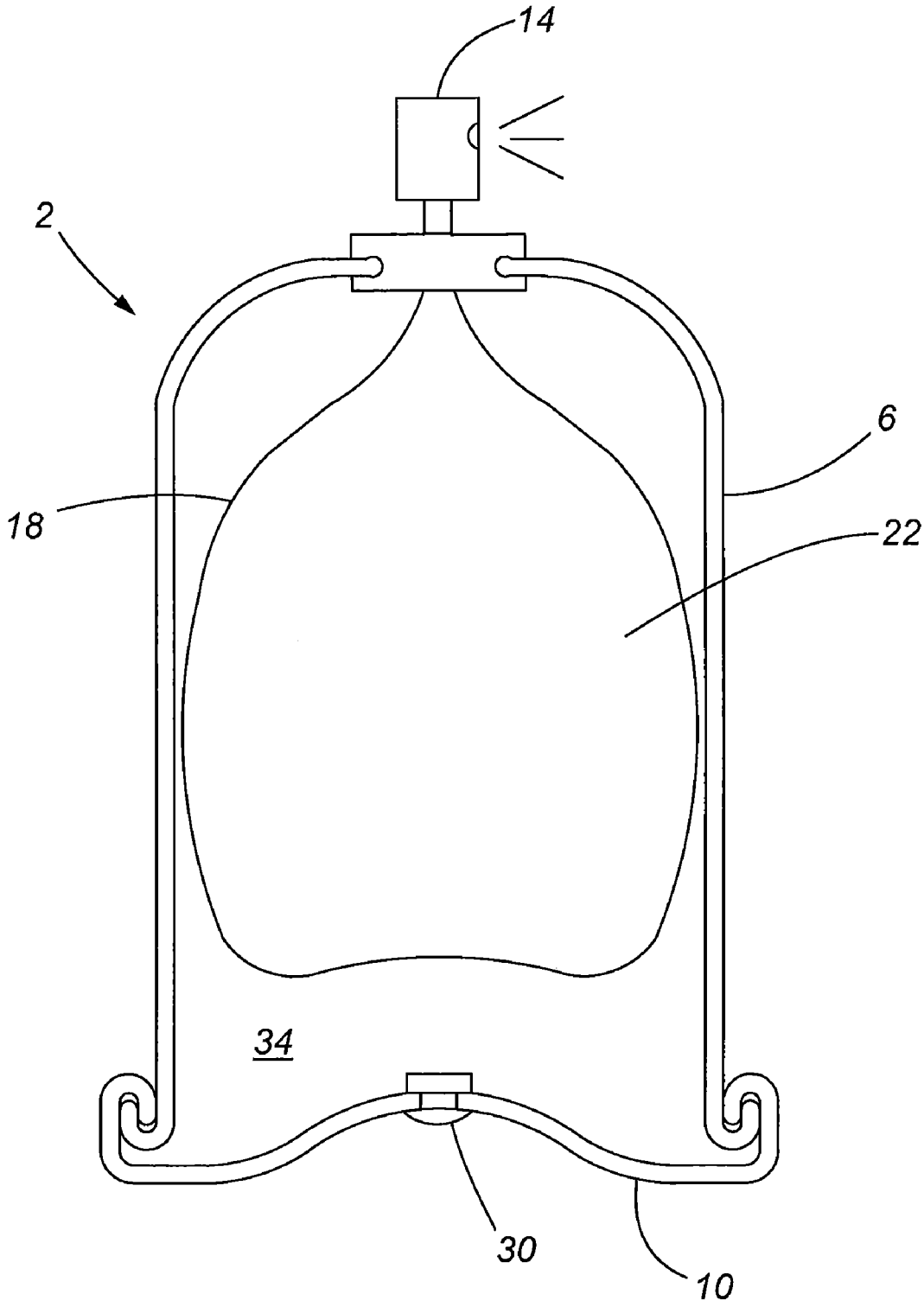
FIG. 1 is a cross-sectional view of a common aerosol container.
Figure 2:
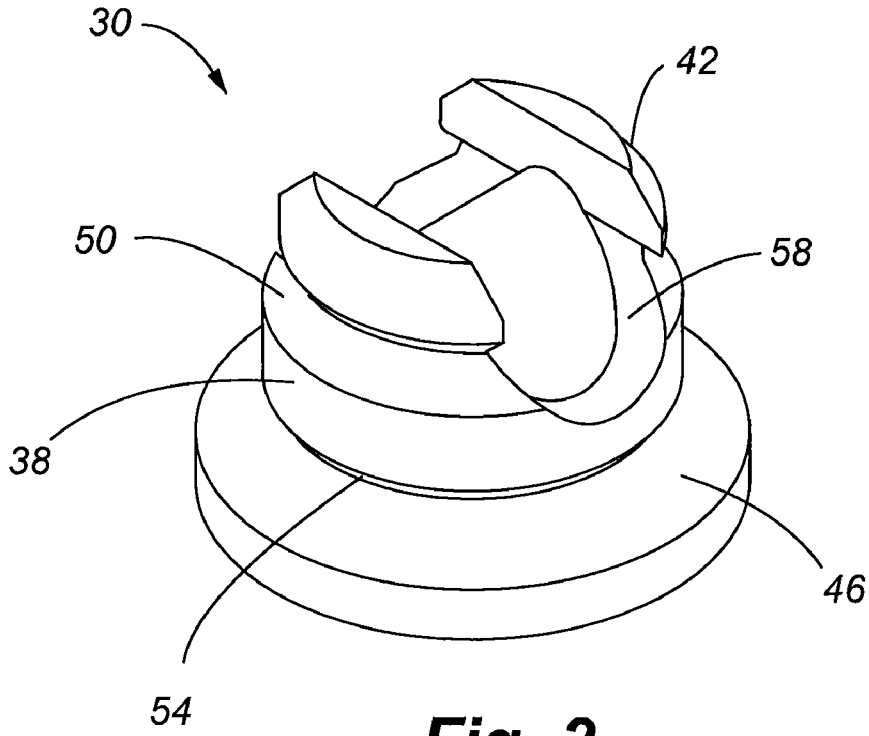
FIG. 2 is a perspective view of a fill valve of one embodiment of the present invention.
Figure 3:
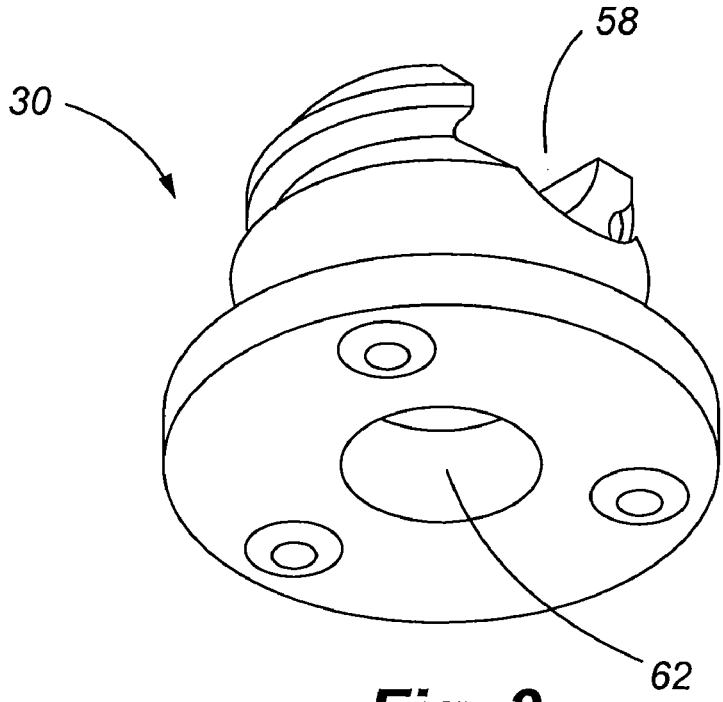
FIG. 3 is a side elevation view of FIG. 2.
Figure 4:
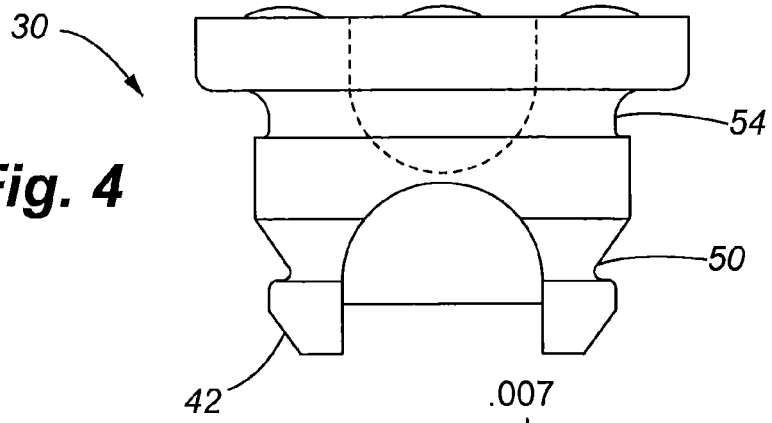
FIG. 4 is a front elevation view of FIG. 2.
Figure 4A:
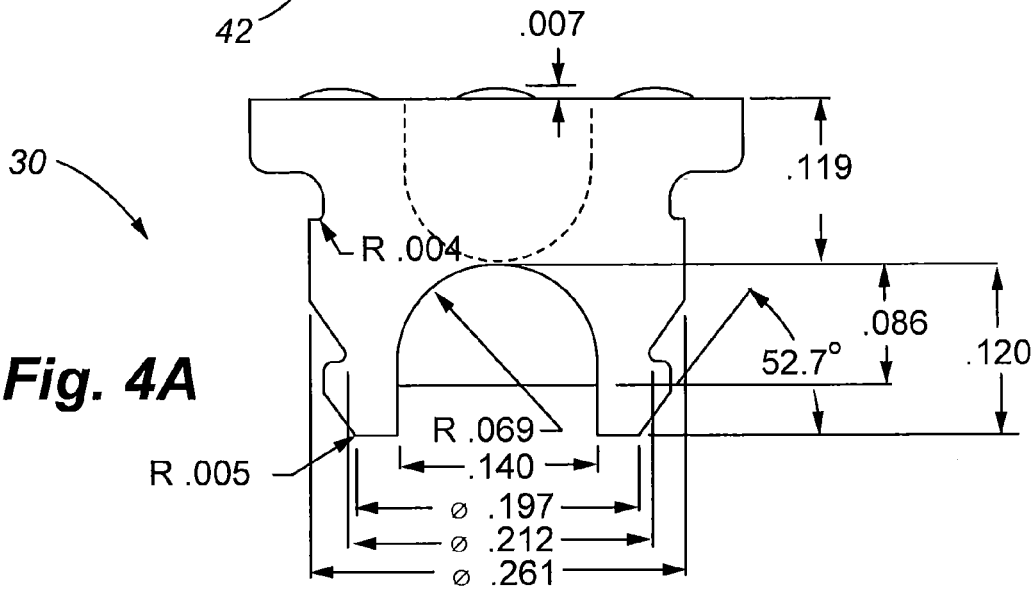
FIG. 4A is a view similar to FIG. 4, wherein dimensions of one embodiment of the invention are provided.

To assist in the understanding of the present invention the following list of components and associated numbering found in the drawings is provided herein:

It should be understood that the drawings are not necessarily to scale. In certain instances, details which are not necessary for an understanding of the invention or which render other details difficult to perceive may have been omitted. It should be understood, of course, that the invention is not necessarily limited to the particular embodiments illustrated herein.

Components
2 Container
6 Container body
10 End closure
14 Valve assembly
18 Product bag
22 Product
26 Aperture
30 Fill valve
34 Propellant chamber
38 Shaft
42 Head
46 Shoulder
50 Upper groove
54 Lower groove
58 Fluid passage
62 Bore
66 Cylindrical portion
70 Conical portion
74 Center axis
78 Center plane
82 Planar surface
86 First point

90 Second point
94 First plane
98 Third point
102 Second plane

DETAILED DESCRIPTION

Referring now to FIGS. 1-9, an aerosol container 2 that includes a cylindrically shaped body 6, a container end closure 10 and a dispensing valve assembly 14 is shown. A product bag 18 is disposed in the container 2 for dispensing a product 22. In order to pressurize the product 22, the container 2 is filled with a pressurized propellant material. The container end closure 10 includes an aperture 26 with a fill valve 30 positioned therein to allow for selective opening and closing of the container 2. A propellant chamber 34 is thus formed in the container and propellant, such as butane, is injected into the container through the fill valve 30 to pressurize the propellant chamber 34 and thus the product bag 18. The fill valve 30 of one embodiment of the present invention is comprised of a shaft 38 that is interconnected on one end to a head 42 and on another end to a shoulder 46. An upper groove 50 is located between the head 42 and the shaft 38 and a lower groove 54 is located between the shaft 38 and the shoulder 46. The upper groove 50 and lower groove 54 are adapted to selectively engage the aperture 26 of the container end closure 10.

Referring now to FIGS. 2-7, the fill valve 30 of one embodiment of the present invention is shown. The fill valve 30 also includes a passage 58 that allows propellant to enter into the container 2 when the upper groove 50 is situated within the aperture 26 of the end closure 10. When filling is complete, the fill valve 30 is transitioned upwardly into the container 2 such that the lower groove 54 is situated within the aperture 26, thus positioning the passages 58 within the container 2.

Figure 6:
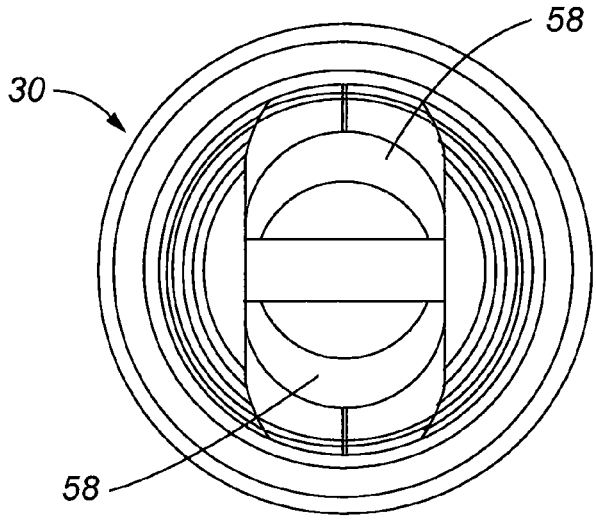
FIG. 6 is a top plan view of the fill valve shown in FIG. 2.
Figure 5:
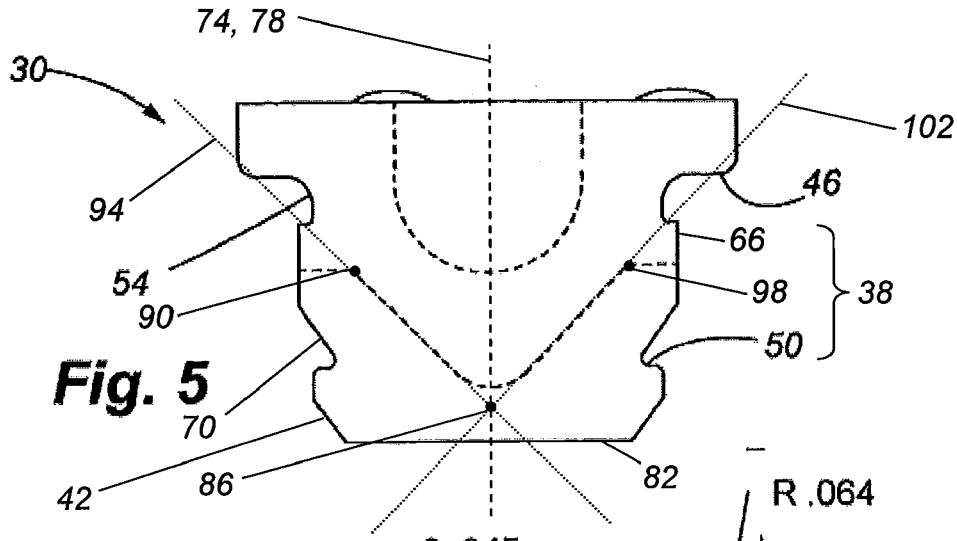
FIG. 5 is a side elevation view of FIG. 2.
Figure 5A:
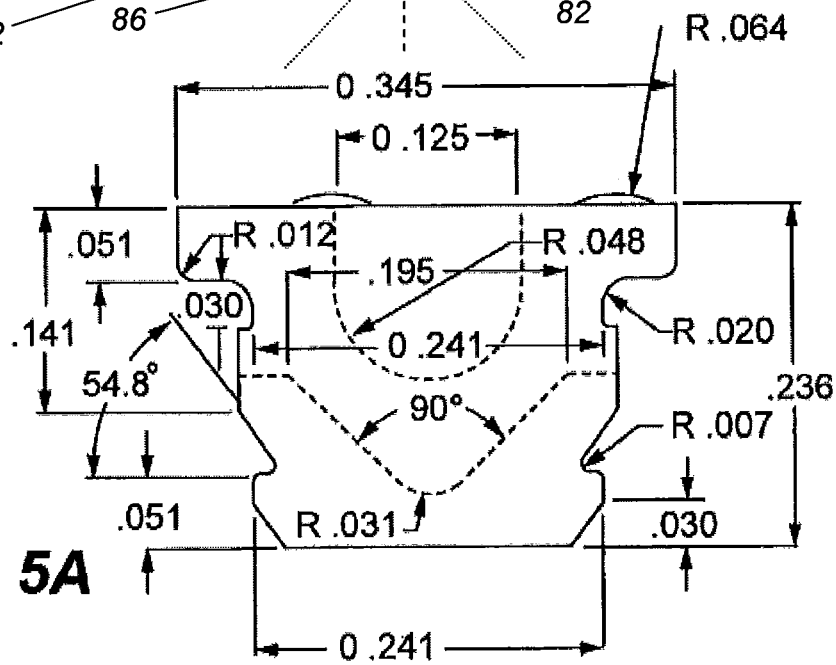
FIG. 5A is a view of FIG. 5 wherein dimensions of one embodiment are provided.
Figure 7:
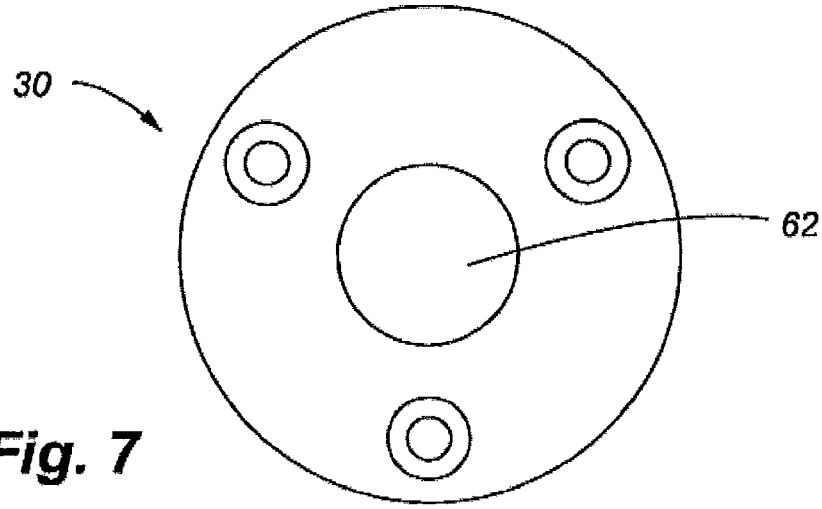
FIG. 7 is a bottom plan view of the fill valve shown in FIG. 2.

More specifically, with reference to FIGS. 5 and 6, the fill valve 30 of one embodiment of the present invention is comprised of a shaft 38. The shaft 38 includes a generally cylindrical portion 70 with a first diameter and a generally conical portion 70, wherein a longitudinal center axis 74 is positioned through the cylindrical portion 70 and the conical portion 74 that defines a center plane 78. The head 42 is interconnected to the conical portion 70 of the shaft 38 with the upper groove 50 positioned therebetween. The head is also defined by a generally planar surface 82 that is generally perpendicular to the center plane 78. The shoulder 46 is interconnected to the cylindrical portion 66 of the shaft 38 with the lower groove 54 therebetween.

The fill valve 30 also includes a fluid passage 58 formed within the head 42 and the shaft 38 that is defined by a first point 86 and a second point 90. The first point 86 is generally located on the longitudinal center axis 74 and positioned a predetermined distance from the planar surface 82 of the head 42. The second point 90 is positioned within the cylindrical portion 66 of the shaft 38 and a predetermined distance from an exterior surface of the cylindrical portion 66. Thus the passage 58 is bounded by a first plane 94 that is defined by the first point 86 and the second point 90 that is angled with respect to the planar surface 82 of the head 42.

Further, the fill valve 30 includes another fluid passage 58 formed within the head 42 and the shaft 38 that is defined by the first point 86 and a third point 98. Similar to the second point 90, the third point 98 is positioned within the cylindrical portion 66 of the shaft 38 and a predetermined distance from the exterior surface of the cylindrical portion 66. Thus the passage 58 is bounded by a second plane 102 that is defined by the first point 86 and the third point 98 that is angled with respect to the first plane 94.

The fill valve 30 must also include a bore 62 partially through its thickness that decreases the wall thickness of the shaft 38. The decrease in thickness associated with the bore 62 allows the fill valve 30 to expand radially when pressure is removed therefrom. This radial expansion presses against the sides of the aperture 26 to enhance the sealing characteristics of the fill valve 30.

Figure 8:
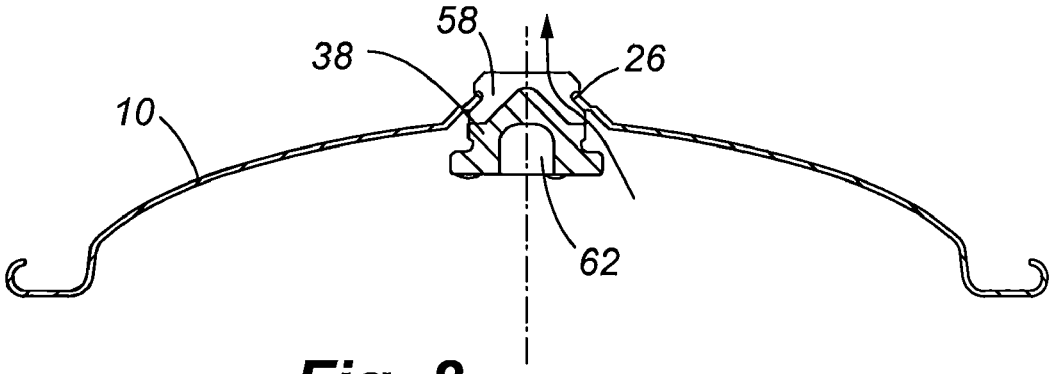
FIG. 8 is a cross-sectional view of a container end with the fill valve engaged thereto for filling of the container.
Figure 9:
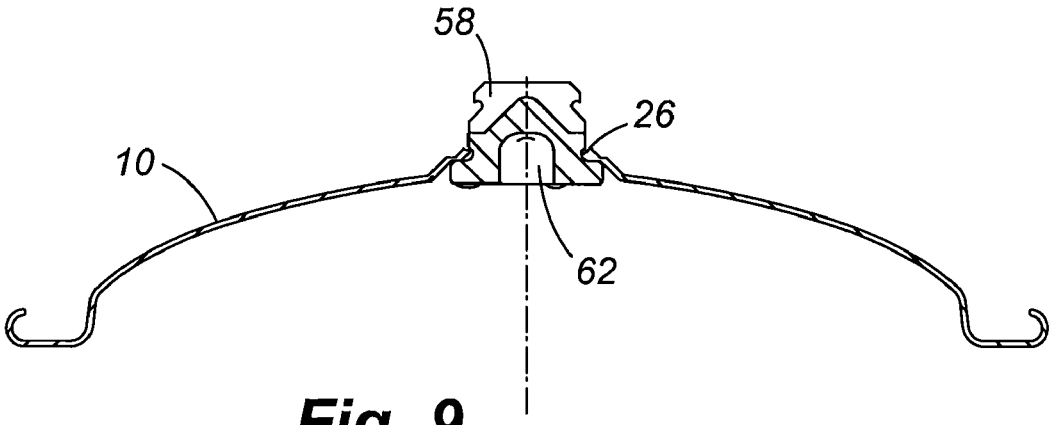
FIG. 9 is a cross-sectional view of the container end showing the fill valve inserted into the container to prevent leakage of propellant therefrom.

Referring now to FIGS. 8 and 9, operation of the fill valve of one embodiment of the present invention is shown. Initially, the upper groove 50 of the fill valve 30 is engaged within the aperture 26, thereby providing a path for fluid flow through the passage 58. Once sufficient pressurized fluid is added to the container, the fill valve 30 is transitioned to a second position wherein the lower groove 54 is placed in contact with the walls engaged within the aperture 26. As shown in FIG. 9, the passages 58 are located inside the container 2 and thus fluid flow is blocked by the shoulder 46. The bore 62 of the fill valve 30 allows for selective radial compression of the fill valve 30 to aid transition from the first position of use to the second position of use.

Referring now to FIG. 9, specifically, when the radial compression is released, the resilient nature of the fill valve 30 will spring outwardly to further contact portions of the end closure 10 to facilitate sealing of the container 2.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims.

What is claimed is:

1. A fill valve that is adapted to engage a fill aperture formed on a bottom portion of an aerosol container, the aerosol container having a dispensing assembly on an upper portion thereof, said fill valve comprising:

a shaft having a generally cylindrical portion with a first diameter and a generally conical portion, said shaft also having a longitudinal center axis that defines a center plane;

a head interconnected to said generally conical portion of said shaft with an upper groove positioned therebetween, said head terminating at a generally planar surface that is generally perpendicular to said center plane;

a shoulder interconnected to said generally cylindrical portion of said shaft with a lower groove therebetween;

a first fluid passage formed within said head and said shaft, said first fluid passage defined by a first point, which is generally located on said longitudinal center axis, and positioned a predetermined distance from said generally planar surface of said head and a second point that is positioned within said generally cylindrical portion of said shaft and a predetermined distance from the exterior surface of said generally cylindrical portion, said first point and said second point lying in a first plane that is angled with respect to said generally planar surface of said head;

a second fluid passage formed within said head and said shaft, said second fluid passage defined by said first point and a third point that is positioned within said generally cylindrical portion of said shaft and a predetermined distance from said exterior surface of said generally cylindrical portion, said first point and said third point lying in a second plane that is angled with respect to said first plane;

wherein said fill valve has a first position of use with said upper groove is engaged onto the fill aperture of the container such that said first fluid passage and said second fluid passage are situated at least partially outside the container to provide fluid flow paths into the container; and wherein said fill valve has a second position of use with said lower groove is engaged onto the fill aperture of the container such that said first fluid passage and said second fluid passage are located within the container and said shoulder is situated outside said container to prevent fluid flow.

2. The fill valve of claim 1 further comprising a bore through said shoulder and said shaft, wherein said bore terminates within said generally cylindrical portion of said shaft.

3. The fill valve of claim 1, wherein said shoulder has an outer diameter greater than the outer diameter of said generally cylindrical portion of said shaft.

4. The fill valve of claim 1, wherein the angle between said first plane and said second plane is about 90 degrees.

5. The fill valve of claim 1, wherein said shoulder is about 0.051 inches thick and about 0.0345 inches in diameter.

6. The fill valve of claim 1, wherein said shoulder includes a generally flat lower surface including at least one protrusion extending therefrom.

7. In combination a fill valve and an aerosol container with a fill aperture formed on a bottom portion of said aerosol container, said aerosol container having a dispensing assembly on an upper portion thereof, comprising:

a shaft having a generally cylindrical portion having a first diameter and a generally conical portion, said shaft also having a center axis that defines a center plane;

a head interconnected to said generally conical portion of said shaft with an upper groove positioned therebetween, said head having a generally planar surface that is generally perpendicular to said center plane;

a shoulder interconnected to said generally cylindrical portion of said shaft with a lower groove therebetween;

a first fluid passage formed within said head and said shaft, said first fluid passage defined by a first point, which is generally located on said longitudinal center axis, and positioned a predetermined distance from said generally planar surface of said head and a second point that is positioned within said generally cylindrical portion of said shaft and a predetermined distance from the exterior surface of said generally cylindrical portion, said first point and said second point lying in a first plane that is angled with respect to said generally planar surface of said head;

a second fluid passage formed within said head and said shaft, said second fluid passage defined by said first point and a third point that is positioned within said generally cylindrical portion of said shaft and a predetermined distance from said exterior surface of said generally cylindrical portion, said first point and said third point lying in a second plane that is angled with respect to said first plane;

wherein said fill valve has a first position of use with said upper groove is engaged onto said fill aperture of the container such that said first fluid passage and said second fluid passage are situated at least partially outside said aerosol container to provide fluid flow paths into said aerosol container; and wherein said fill valve has a second position of use with said lower groove is engaged onto said fill aperture of said aerosol container such that said first fluid passage and said second fluid passage are located within the container and said shoulder is situated outside said aerosol container to prevent fluid flow.

8. The fill valve of claim 7 further comprising a bore through said shoulder and said shaft, wherein said bore terminates within said generally cylindrical portion of said shaft.

9. The fill valve of claim 7, wherein said shoulder has an outer diameter greater than the outer diameter of said generally cylindrical portion of said shaft.

10. The fill valve of claim 7, wherein said shoulder is about 0.051 inches thick and about 0.0345 inches in diameter.

* * * * *